US010378398B2

(12) United States Patent
Lee

(10) Patent No.: US 10,378,398 B2
(45) Date of Patent: Aug. 13, 2019

(54) PISTON COOLING APPARATUS FOR VEHICLE

(71) Applicants: HYUNDAI MOTOR COMPANY, Seoul (KR); KIA MOTORS CORPORATION, Seoul (KR)

(72) Inventor: Byung Hyun Lee, Bucheon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 200 days.

(21) Appl. No.: 15/682,027

(22) Filed: Aug. 21, 2017

(65) Prior Publication Data

US 2018/0163585 A1 Jun. 14, 2018

(30) Foreign Application Priority Data

Dec. 13, 2016 (KR) ..... 10-2016-0169987

(51) Int. Cl.
*F01M 1/16* (2006.01)
*F01M 1/08* (2006.01)
*F01M 11/02* (2006.01)

(52) U.S. Cl.
CPC ..... *F01M 1/16* (2013.01); *F01M 1/08* (2013.01); *F01M 11/02* (2013.01)

(58) Field of Classification Search
CPC ..... F01M 1/12; F01M 11/0004; F01M 11/02; F01M 5/02
USPC ..... 184/104.2
See application file for complete search history.

(56) References Cited

U.S. PATENT DOCUMENTS 1,443,006 A * 1/1923 Church ..... F01P 7/16 123/142.5 R
1,914,662 A * 6/1933 Dickieson, Jr. ..... F16N 39/00 123/41.44
3,114,360 A * 12/1963 Snelling ..... F02N 19/02 123/142.5 E
4,854,276 A * 8/1989 Elsbett ..... F01M 1/12 123/196 AB
4,936,417 A * 6/1990 Groddeck ..... F01M 1/16 184/18
5,159,910 A * 11/1992 Ninomiya ..... F01M 1/12 123/196 AB
5,647,315 A * 7/1997 Saito ..... F01M 11/0004 123/195 C
6,494,294 B1 * 12/2002 Kubota ..... F01M 3/02 137/625.48

(Continued)

OTHER PUBLICATIONS

Toyota AR series engines article from http://toyata-club.net/files/faq/16-01-01_faq_ar-engine_eng.htm, 22 pages, printed on Mar. 22, 2017.

*Primary Examiner* — Henry Y Liu
(74) *Attorney, Agent, or Firm* — Brinks Gilson & Lione

(57) ABSTRACT

A piston cooling apparatus for a vehicle, includes: a first gallery that is formed at one side of a cylinder block in a length direction, and receives an oil from an oil pump; a second gallery that is formed at the other side of the cylinder block in a length direction, and supplies the oil into piston cooling jets; and a solenoid valve that is disposed at one side of a hydraulic line of the second gallery. In particular, the solenoid valve bypasses the oil supplied from the first gallery and selectively supplies the oil to the second gallery.

15 Claims, 7 Drawing Sheets

(56) References Cited

U.S. PATENT DOCUMENTS

| | | | | |
|---|---|---|---|---|
| 6,540,047 | B2 * | 4/2003 | Yasui | F01M 11/02 123/196 AB |
| 7,089,904 | B2 * | 8/2006 | Morii | F01M 1/12 123/192.2 |
| 7,600,500 | B2 * | 10/2009 | Mizuno | F01M 1/02 123/196 R |
| 7,669,573 | B2 * | 3/2010 | Ogasawara | B62J 25/00 123/192.2 |
| 7,946,388 | B2 * | 5/2011 | Kobayashi | F01M 5/02 184/1.5 |
| 2005/0098385 | A1 * | 5/2005 | Ono | F04C 14/065 184/6.5 |
| 2008/0308353 | A1 * | 12/2008 | Aixala | F01M 1/16 184/6.5 |
| 2009/0293834 | A1 * | 12/2009 | Ono | F04C 2/102 123/196 R |
| 2009/0301413 | A1 * | 12/2009 | Ogawa | F01M 1/08 123/41.48 |
| 2015/0114336 | A1 * | 4/2015 | Matsuda | F01M 1/02 123/196 A |
| 2016/0222843 | A1 * | 8/2016 | Koguchi | F01M 1/16 |
| 2016/0230640 | A1 * | 8/2016 | Kamimura | F01P 3/08 |
| 2016/0363034 | A1 * | 12/2016 | Kim | F01P 3/08 |
| 2017/0114681 | A1 * | 4/2017 | Tsukamoto | F01M 1/06 |
| 2018/0030867 | A1 * | 2/2018 | Honda | B60K 6/50 |
| 2018/0347419 | A1 * | 12/2018 | Furuishi | F01M 1/16 |

* cited by examiner

PISTON COOLING APPARATUS FOR VEHICLE

CROSS-REFERENCE TO RELATED APPLICATION

This application claims priority to and the benefit of Korean Patent Application No. 10-2016-0169987, filed on Dec. 13, 2016, the entire contents of which are incorporated herein by reference.

FIELD

The present disclosure relates to a piston cooling apparatus for a vehicle.

BACKGROUND

The statements in this section merely provide background information related to the present disclosure and may not constitute prior art.

In general, an engine is composed of many parts, and metal parts are moved while being in contact with each other. Heat caused by friction is generated when the metal parts are moved while being in contact with each other.

To prevent damage of the metal parts due to the frictional heat, a coolant is used, and an oil as lubricant is used to reduce friction between the metal parts.

In the engine, the oil is sent to each part based on the operation of an oil pump, is supplied to a main oil gallery provided in a cylinder block, and is supplied to a piston cooling jet connected to the main oil gallery. The piston cooling jet is installed to inject the cooling oil toward the piston.

The cylinder block for a vehicle engine is fabricated by a high pressure casting method. The high pressure casting method has the advantages of high productivity, mass production, and reduced material weight.

However, we have discovered that the cylinder block formed by high pressure casting method has a problem that the diameter of the oil gallery is large. As a result, the amount of oil supplied to the piston cooling jet is increased, responsiveness is deteriorated as the oil injection time is delayed, and fuel efficiency and exhaust gas purification performance deteriorate.

The above information disclosed in this Background section is only for enhancement of understanding of the background of the present disclosure and therefore it may contain information that does not form the prior art that is already known to a person of ordinary skill in the art.

SUMMARY

The present disclosure provides a piston cooling apparatus for a vehicle mounted an oil supply pipe or an insert in the gallery formed in the cylinder block.

An exemplary form of the present disclosure provides a piston cooling apparatus for a vehicle, including: a first gallery formed at a first side of a cylinder block in a length direction of the cylinder block, and configured to receive an oil from an oil pump; a second gallery formed at a second side of the cylinder block in the length direction, and configured to supply the oil into piston cooling jets; and a solenoid valve disposed at one side of a hydraulic line of the second gallery, and configured to bypass the oil supplied from the first gallery and selectively supply the oil to the second gallery.

The piston cooling apparatus may further include an oil supply pipe that is disposed along an interior circumference of the second gallery and has first and second ends, both ends being closed, and includes an oil chamber through which oil passes.

The oil supply pipe may be integrally formed with the cylinder block.

The oil supply pipe may include a partition configured to divide the oil chamber into at least two spaces, and a plurality of oil supplying holes formed to correspond to positions of the piston cooling jets.

The solenoid valve may be disposed to correspond to a position of the partition, and selectively bypasses the oil supplied from the first gallery.

The oil supply pipe may include an oil inflow hole configured to receive the oil of the first gallery, a first bypass hole configured to bypass the oil into the solenoid valve, and a second bypass hole configured to supply the oil bypassed by an operation of opening and closing of the solenoid valve into the second gallery.

Another exemplary form of the present disclosure provides a piston cooling apparatus for a vehicle, including: a first gallery formed at a first side of a cylinder block in a length direction of the cylinder block, and configured to receive oil from an oil pump; a second gallery formed at a second side of the cylinder block in the length direction, and configured to supply the oil into piston cooling jets; and an insert mounted in the inside of the second gallery and configured to increase a hydraulic pressure of the oil flowing into the second gallery.

The second gallery may be formed so that the diameter of both end portions of the second gallery gradually increases from a center of the cylinder block in the length direction.

A groove may be formed in the insert so as to correspond to the position of the center of the second gallery where the diameter is decreased.

The piston cooling apparatus may further include a solenoid valve that is disposed at one side of a hydraulic line of the second gallery, and bypasses the oil supplied from the first gallery to selectively supply the oil to the second gallery.

An oil blocking unit may be formed in the insert and divide the second gallery at least two portions, and the solenoid valve is disposed at one side of the oil blocking unit and selectively bypasses the oil supplied from the first gallery.

Yet another exemplary form of the present disclosure provides a piston cooling apparatus for a vehicle, including: a first gallery formed at a first side of a cylinder block in a length direction of the cylinder block, and configured to receive oil from an oil pump; a second gallery formed at a second side of the cylinder block in the length direction, and configured to supply the oil supplied from the first gallery into piston cooling jets; and an oil supply pipe disposed along an interior circumference of the second gallery and formed with an oil chamber through which oil passes. The oil supply pipe includes a plurality of oil supplying holes formed to correspond to positions of the piston cooling jets.

The oil supply pipe may include a partition configured to divide the oil chamber into at least two passages.

The piston cooling apparatus may further include a solenoid valve that is disposed at one side of the partition, and bypasses the oil supplied from the first gallery and selectively supplies the oil to the second gallery.

The piston cooling apparatus may further include an insert that is mounted in the inside of the oil chamber and increases a hydraulic pressure of the oil flowing into the oil chamber.

According to the exemplary form of the present disclosure, by forming galleries both sides of the cylinder block and selectively supplying to the second gallery by bypassing the oil supplied from the first gallery, it is possible to improve the injection response of the piston cooling jet and improve a fuel consumption of the vehicle.

Further, the oil supply pipe and the insert are mounted in the second gallery, and thus it is possible to reduce the amount of the oil supplied into the second gallery and increase the pressure of the oil supplied to the piston cooling jet.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
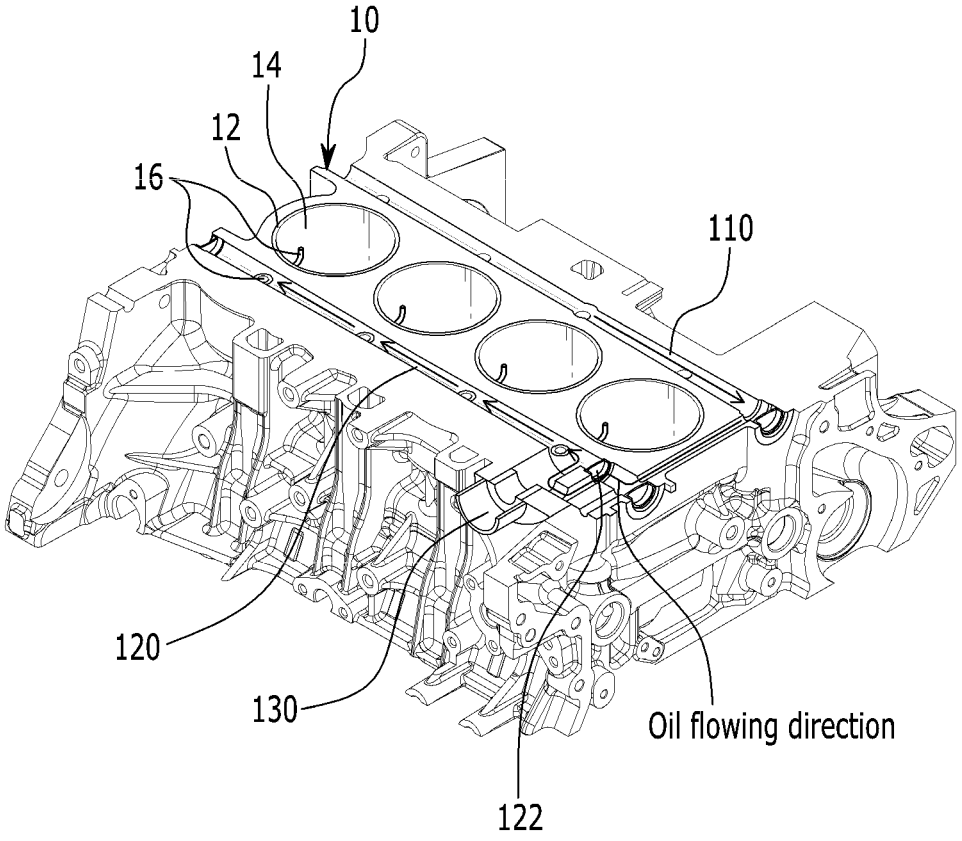
FIG. 1 is a view illustrating a piston cooling apparatus for a vehicle formed in a cylinder block.

The drawings described herein are for illustration purposes only and are not intended to limit the scope of the present disclosure in any way.

DETAILED DESCRIPTION

In the following detailed description, only certain exemplary forms of the present disclosure have been shown and described, simply by way of illustration. Thus, the following description is not intended to limit the present disclosure, application, or uses. It should be understood that throughout the drawings, corresponding reference numerals indicate like or corresponding parts and features.

As those skilled in the art would realize, the described forms may be modified in various different ways, all without departing from the spirit or scope of the present disclosure.

Throughout the present disclosure, unless explicitly described to the contrary, the word "comprise" and variations such as "comprises" or "comprising" will be understood to imply the inclusion of stated elements but not the exclusion of any other elements.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles, and other alternative fuel vehicles (e.g., fuel derived from resources other than petroleum).

A piston cooling apparatus for a vehicle according to the exemplary form of the present disclosure will now be described with reference to FIG. 1 to FIG. 7.

Figure 2:
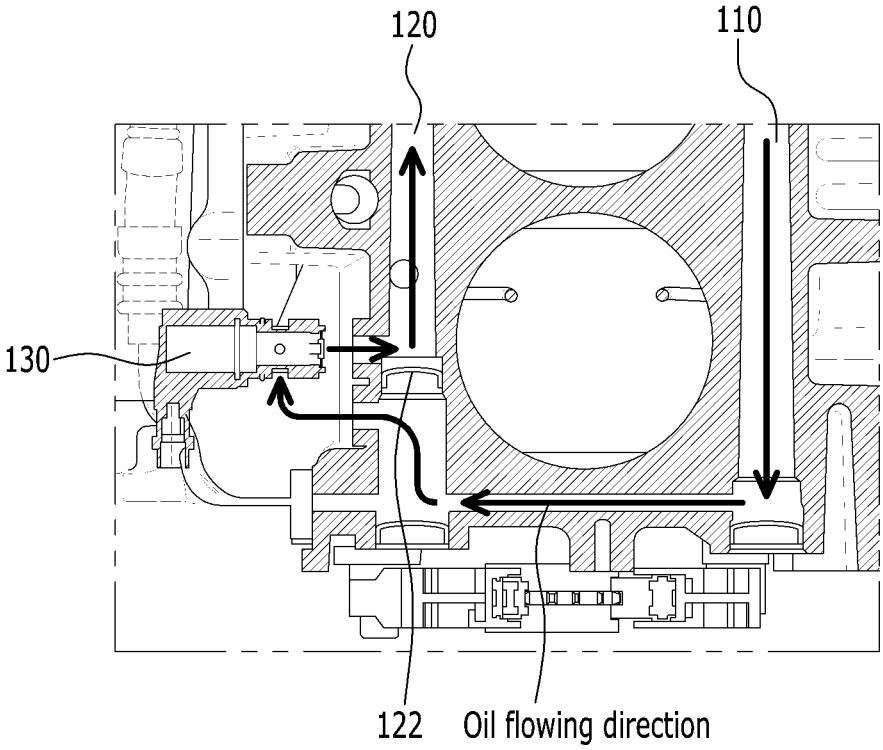
FIG. 2 is a view partially showing a piston cooling apparatus for a vehicle.
Figure 3:
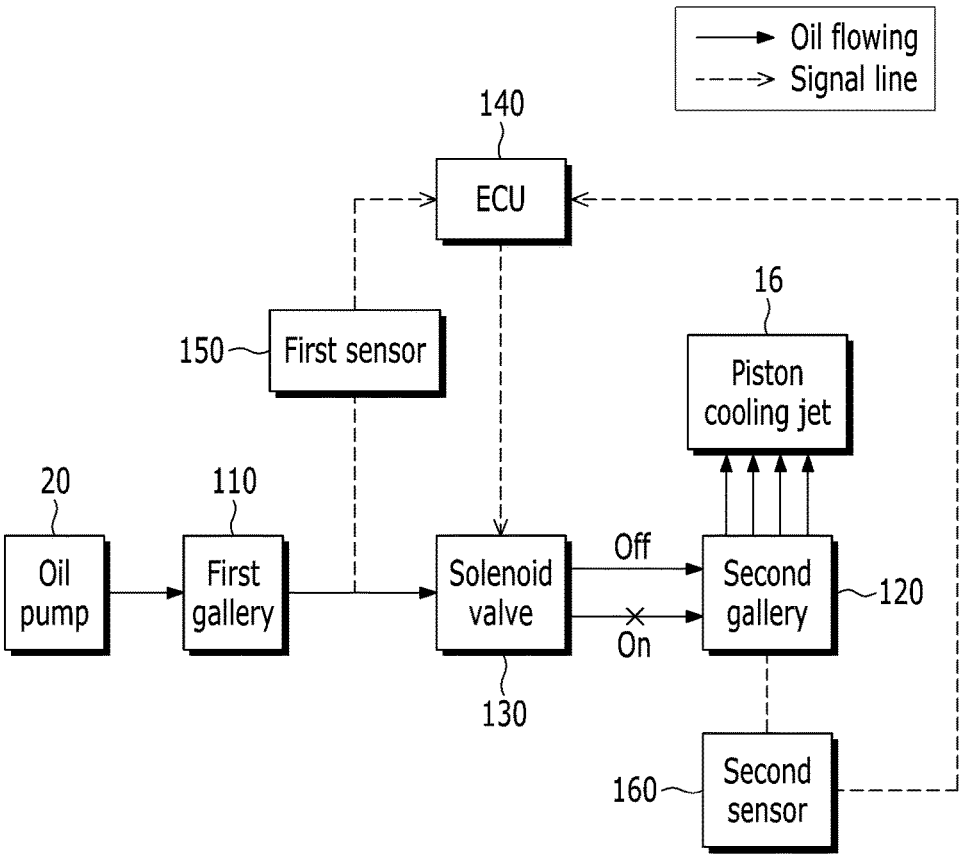
FIG. 3 is a schematic view showing oil flow of a piston cooling apparatus for a vehicle.

FIG. 1 is a view illustrating a piston cooling apparatus for a vehicle formed in a cylinder block according to an exemplary form of the present disclosure, FIG. 2 is a view partially showing a piston cooling apparatus for a vehicle according to an exemplary form of the present disclosure, and FIG. 3 is a view showing oil flow of a piston cooling apparatus for a vehicle according to an exemplary form of the present disclosure. In this case, the piston cooling apparatus for a vehicle describes only a schematic configuration desired for description according to an exemplary form of the present disclosure, and is not limited to such a configuration.

Referring to FIG. 1 and FIG. 2, the piston cooling apparatus is installed to a cylinder block 10 including a cylinder 12 in which a piston 14 is lifted. The piston cooling apparatus supplies piston cooling oil to the piston cooling jet 16 injecting the piston cooling oil toward the piston 14.

The piston cooling apparatus may include a first gallery 110, a second gallery 120, and a solenoid valve 130.

The first gallery 110 is formed at one side of the cylinder block 10 in a length direction, and receives the oil from an oil pump 20.

The second gallery 120 is formed at the other side of the cylinder block 10 in a length direction. The second gallery 120 receives the oil from the first gallery 110, and supplies the oil to the piston cooling jet 16. The second gallery 120 may be formed so that the diameter of both end portions increases based on a center of the length direction of the cylinder block 10.

The second gallery 120 is formed with a blocking unit 122 for dividing the second gallery 120 into at least two portions. The blocking unit 122 may inhibit or prevent the oil of the first gallery 110 from being directly supplied to the piston cooling jet 16.

The solenoid valve 130 is disposed at one side of the portion where the hydraulic line of the second gallery 120 is separated. For example, the solenoid valve 130 may be disposed at one side of the blocking unit 122 that divides the second gallery 120 into at least two portions.

In addition, the solenoid valve 130 may bypass the oil supplied from the first gallery 110 by on-off control of an ECU 140, and selectively supply to the second gallery 120.

Referring to FIG. 3, the oil supplied from the oil pump 20 to the first gallery 110 is supplied to the second gallery 120 through the on-off operation of the solenoid valve 130. A first sensor 150 detects oil pressure and temperature of the first gallery 110 and provides the oil pressure and the temperature to the ECU 140. And a second sensor 160 detects oil pressure and temperature of the second gallery 120, and provides the oil pressure and the temperature the ECU 140.

The ECU 140 controls the on-off operation of the solenoid valve 130 based on information of engine speed and an engine load, and oil pressure and temperature of galleries. The ECU 140 may selectively supply the oil of the first gallery 110 into the second gallery 120 by controlling the on-off operation of the solenoid valve 130, and supply the oil to the piston cooling jet 16 by increasing oil pressure in the second gallery 120.

Accordingly, in the piston cooling apparatus for the vehicle, by forming galleries both sides of the cylinder block 10, and selectively supplying to the second gallery 120 by bypassing through the solenoid valve 130 the oil supplied from the first gallery 110, it is possible to improve the injection response of the piston cooling jet and improve a fuel consumption of the vehicle.

Figures 4A, 4B:
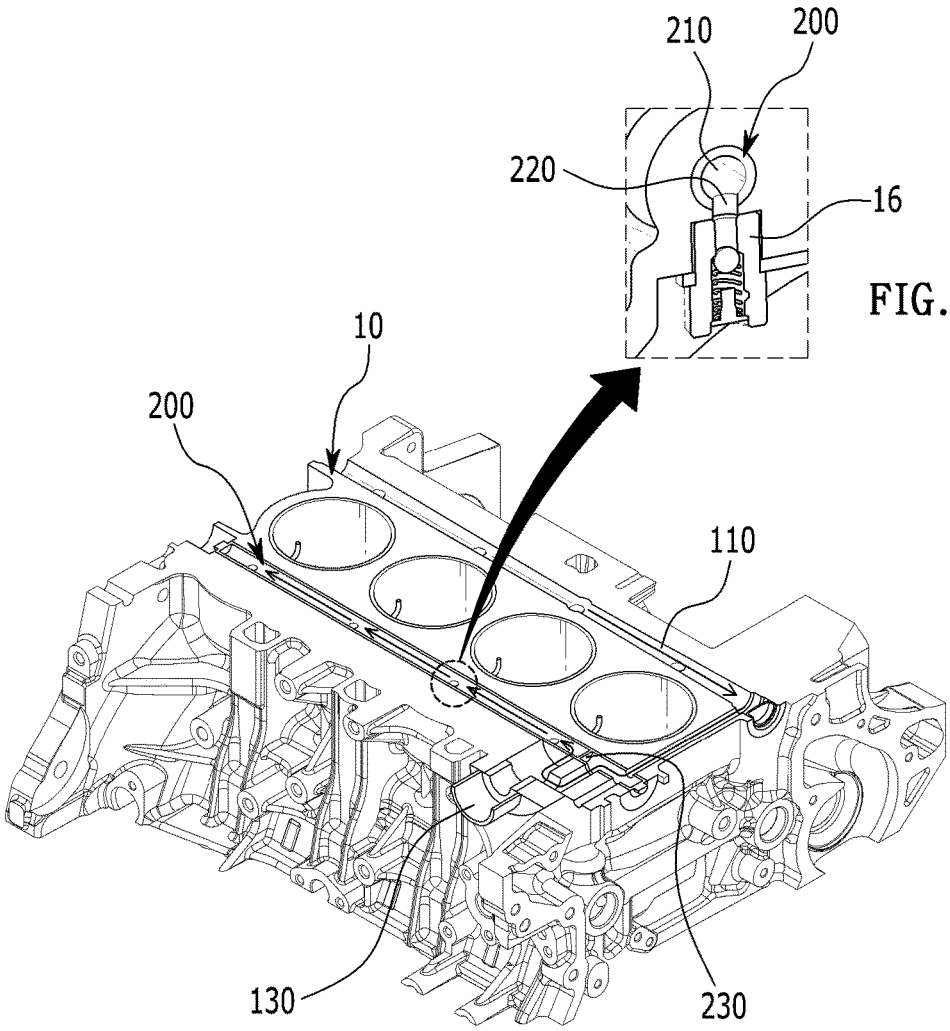
FIG. 4A is a view illustrating a piston cooling apparatus for a vehicle formed in a cylinder block.
FIG. 4B is an enlarged view of a part identified in FIG. 4A.
Figure 5:
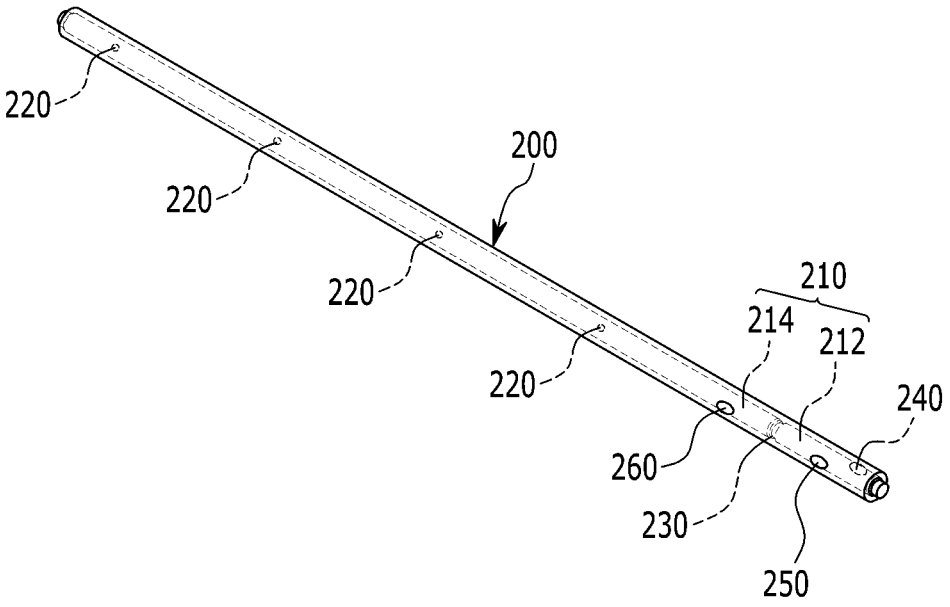
FIG. 5 is a view showing an oil supply pipe provided for a piston cooling apparatus for a vehicle.

FIGS. 4A-4B are views illustrating a piston cooling apparatus for a vehicle formed in a cylinder block according to another exemplary form of the present disclosure, and FIG. 5 is a view showing an oil supply pipe provided for a piston cooling apparatus for a vehicle in according to another exemplary form of the present disclosure. The same constituent elements as the exemplary forms described above designate the same reference numerals, and the duplicated description is omitted.

Referring to FIGS. 4A, 4B and FIG. 5, the piston cooling apparatus for the vehicle further includes an oil supply pipe 200 formed in close contact with the interior circumference of the second gallery 120. The oil supply pipe 200 is formed in a cylinder shape, and the both ends are closed. The oil supply pipe 200 is integrally formed with the cylinder block 10 formed by a high pressure casting method.

The oil supply pipe 200 is formed with an oil chamber 210, a plurality of oil supplying hole 220, a partition 230, an oil inflow hole 240, a first bypass hole 250, and a second bypass hole 260.

The partition 230 divides the oil chamber 210 into at least two spaces. That is, the oil chamber 210 may be separated into the bypass chamber 212 and the oil supply chamber 214 by the partition 230. In addition, a plurality of oil supplying hole 220 are formed corresponding to the positions of the piston cooling jet 16, respectively.

The oil of the first gallery 110 is supplied to the bypass chamber 212 through the oil inflow hole 240. The oil supplied to the bypass chamber 212 is transferred to the oil supply chamber 214 through the first bypass hole 250 and the second bypass hole 260 by the opening and closing operation of the solenoid valve 130.

The oil supplied from the first gallery 110 passes the oil chamber 210 formed in the oil supply pipe 200, and is supplied to the piston cooling jet 16 via the oil supplying hole 220.

Accordingly, in the piston cooling apparatus, by forming the oil supply pipe 200 formed in a cylinder shape to be in close contact with the interior circumference of the second gallery 120, it is possible to reduce the amount of the oil supplied into the second gallery 120, and increase the pressure of the oil supplied to the piston cooling jet 16.

With this arrangement, the piston cooling apparatus reduces the amount of the oil supplied into the second gallery 120. Therefore, fuel efficiency can be improved and exhaust gas can be reduced.

Figures 6A, 6B, 6C:
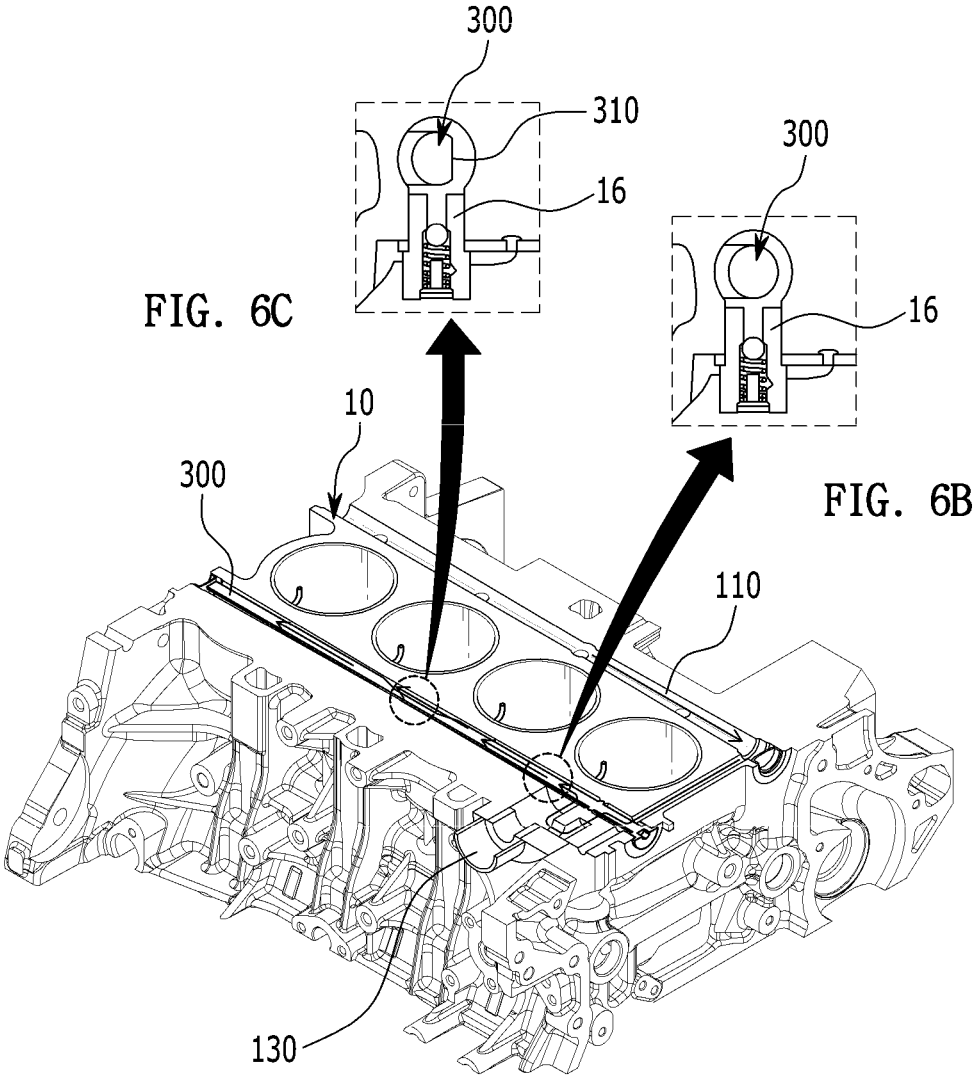
FIG. 6A is a view illustrating a piston cooling apparatus for a vehicle formed in a cylinder block.
FIGS. 6B and 6C are enlarged views of parts identified in FIG. 6A.
Figure 7:
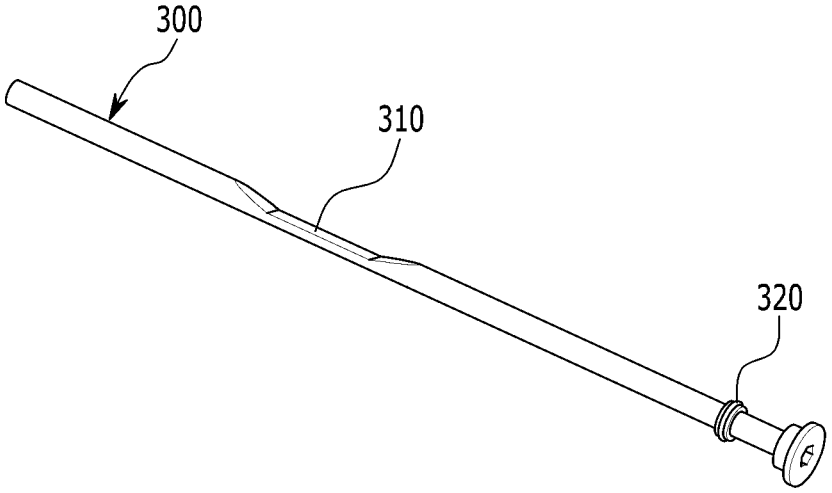
FIG. 7 is a view showing an insert provided for a piston cooling apparatus for a vehicle.

FIGS. 6A-6C are views illustrating a piston cooling apparatus for a vehicle formed in a cylinder block according to still another exemplary form of the present disclosure, and FIG. 7 is a view showing an insert provided for a piston cooling apparatus for a vehicle in according to still another exemplary form of the present disclosure. The same reference numerals will be used to refer to the same constituent elements throughout the exemplary form and detailed description about the same elements will be omitted in order to avoid redundancy.

Referring to FIGS. 6A-6C, and FIG. 7, the piston cooling apparatus further includes an insert 300 mounted at the inside of the second gallery 120 to increase a hydraulic pressure of the oil flowing into the second gallery 120.

The oil supplied to the second gallery 120 is supplied to the piston cooling jet 16 through the gap formed between the interior circumference of the second gallery 120 and the exterior circumference of the insert 300.

The insert 300 includes a groove 310 formed in the center of the insert 300, and an oil blocking unit 320 formed to divide the second gallery 120.

The second gallery 120 may be formed so that the diameter of both end portions of the second gallery increases with respect to a center of the cylinder block 10 in its length direction. The groove 310 may be formed in the insert 300 so as to correspond to the position of the center of the second gallery 120 where the diameter is decreased.

Accordingly, the piston cooling apparatus mounts the insert 300 formed the groove 310 into the second gallery 120, it is possible to enable a smooth flow of the oil and uniformly maintain the oil pressure in the second gallery 120.

The oil blocking unit 320 divides the second gallery 120 into at least two spaces to inhibit or prevent the oil of the first gallery 110 from being supplied directly to the piston cooling jet 16.

The solenoid valve 130 is disposed at one side of the oil blocking unit 320, and supplies to the second gallery 120 by selectively bypassing the oil supplied from the first gallery 110.

Although not shown in the figure, the insert 300 may be mounted in the oil supply pipe 200 in FIGS. 4A and 4B. For example, the piston cooling apparatus for the vehicle modifies a shape of the insert 300 and mounts the modified insert 300 inside of the oil supply pipe 200, it is possible to reduce the space of the oil chamber 210 through which the oil flows, and increase hydraulic pressure of the oil flowing in the oil chamber 210.

As described, the piston cooling apparatus for the vehicle according to an exemplary form of the present disclosure forms galleries both sides of the cylinder block and selectively supplies to the second gallery by bypassing the oil supplied from the first gallery. Therefore, it is possible to improve the injection response of the piston cooling jet and improve a fuel consumption of the vehicle.

Further, in the piston cooling apparatus for the vehicle according to an exemplary form of the present disclosure, the oil supply pipe and the insert are mounted in the second gallery, and thus it is possible to reduce the amount of the oil supplied into the second gallery and increase the pressure of the oil supplied to the piston cooling jet.

While this present disclosure has been described in connection with what is presently considered to be practical exemplary forms, it is to be understood that the present disclosure is not limited to the disclosed forms, but, on the contrary, is intended to cover various modifications and equivalent arrangements included within the spirit and scope of the present disclosure.

What is claimed is:

1. A piston cooling apparatus for a vehicle, comprising:

a first gallery formed at a first side of a cylinder block in a length direction of the cylinder block, and configured to receive an oil from an oil pump;

a second gallery formed at a second side of the cylinder block in the length direction, and configured to supply the oil into piston cooling jets; and a solenoid valve disposed at one side of a hydraulic line of the second gallery, and configured to bypass the oil supplied from the first gallery and selectively supply the oil to the second gallery.

2. The piston cooling apparatus of claim 1, further comprising:

an oil supply pipe that is disposed along an interior circumference of the second gallery, has first and second ends, both ends being closed, and includes an oil chamber through which oil passes.

3. The piston cooling apparatus of claim 2, wherein the oil supply pipe is integrally formed with the cylinder block.

4. The piston cooling apparatus of claim 2, wherein the oil supply pipe includes:

a partition configured to divide the oil chamber into at least two spaces; and a plurality of oil supplying holes formed to correspond to positions of the piston cooling jets.

5. The piston cooling apparatus of claim 4, wherein the solenoid valve is disposed to correspond to a position of the partition.

6. The piston cooling apparatus of claim 2, wherein the oil supply pipe includes:

an oil inflow hole configured to receive the oil of the first gallery;

a first bypass hole configured to bypass the oil into the solenoid valve; and a second bypass hole configured to supply the oil bypassed by an operation of opening and closing of the solenoid valve into the second gallery.

7. A piston cooling apparatus for a vehicle, comprising:

a first gallery formed at a first side of a cylinder block in a length direction thereof, and configured to receive oil from an oil pump;

a second gallery formed at a second side of the cylinder block in the length direction, and configured to supply the oil into piston cooling jets; and an insert mounted at an inside of the second gallery and configured to increase a hydraulic pressure of the oil flowing into the second gallery.

8. The piston cooling apparatus of claim 7, wherein the second gallery is formed so that a diameter of both end portions of the second gallery gradually increases from a center of the cylinder block in the length direction.

9. The piston cooling apparatus of claim 8, wherein a groove is formed in the insert so as to correspond to a position of the center of the second gallery where the diameter is decreased.

10. The piston cooling apparatus of claim 7, further comprising:

a solenoid valve that is disposed at one side of a hydraulic line of the second gallery, and bypasses the oil supplied from the first gallery to selectively supply the oil to the second gallery.

11. The piston cooling apparatus of claim 10, wherein an oil blocking unit is formed in the insert and divides the second gallery into at least two portions, and the solenoid valve is disposed at one side of the oil blocking unit and selectively bypasses the oil supplied from the first gallery.

12. A piston cooling apparatus for a vehicle, comprising:

a first gallery formed at a first side of a cylinder block in a length direction thereof, and configured to receive oil from an oil pump;

a second gallery formed at a second side of the cylinder block in the length direction, and configured to supply the oil supplied from the first gallery into piston cooling jets; and an oil supply pipe disposed along an interior circumference of the second gallery and formed with an oil chamber through which oil passes, the oil supply pipe including a plurality of oil supplying holes formed to correspond to positions of the piston cooling jets.

13. The piston cooling apparatus of claim 12, wherein the oil supply pipe includes a partition configured to divide the oil chamber into at least two passages.

14. The piston cooling apparatus of claim 13, further comprising:

a solenoid valve disposed at one side of the partition, and configured to bypass the oil supplied from the first gallery and selectively supply the oil to the second gallery.

15. The piston cooling apparatus of claim 12, further comprising:

an insert mounted in an inside of the oil chamber and configured to increase a hydraulic pressure of the oil flowing into the oil chamber.

* * * * *